US012330259B2

(12) United States Patent
Kang et al.

(10) Patent No.: US 12,330,259 B2
(45) Date of Patent: Jun. 17, 2025

(54) COMBINED GRINDING WHEEL FOR ULTRASONIC MACHINING AND DESIGN METHOD THEREFOR

(71) Applicant: DALIAN UNIVERSITY OF TECHNOLOGY, Liaoning (CN)

(72) Inventors: Renke Kang, Liaoning (CN); Zhigang Dong, Liaoning (CN); Yidan Wang, Liaoning (CN); Xianglong Zhu, Liaoning (CN); Shang Gao, Liaoning (CN); Yan Bao, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 761 days.

(21) Appl. No.: 17/597,678

(22) PCT Filed: Aug. 29, 2019

(86) PCT No.: PCT/CN2019/103151
§ 371 (c)(1),
(2) Date: Apr. 22, 2022

(87) PCT Pub. No.: WO2021/007924
PCT Pub. Date: Jan. 21, 2021

(65) Prior Publication Data

US 2022/0324076 A1 Oct. 13, 2022

(30) Foreign Application Priority Data

Jul. 17, 2019 (CN) ..... 201910643619.7

(51) Int. Cl.
*B24B 1/04* (2006.01)
*B24D 7/18* (2006.01)

(52) U.S. Cl.
CPC . *B24B 1/04* (2013.01); *B24D 7/18* (2013.01)

(58) Field of Classification Search
CPC . B28D 7/02; B28D 1/146; B28D 1/14; B24D 35/00; B24D 35/005; B24D 7/10;
(Continued)

(56) References Cited

U.S. PATENT DOCUMENTS 3,882,646 A * 5/1975 Stritzel ..... B23F 21/023 451/470

FOREIGN PATENT DOCUMENTS

CN 101674919 A 3/2010
CN 106493648 A 3/2017
(Continued)

*Primary Examiner* — Eric J Rosen
*Assistant Examiner* — John C Merino
(74) *Attorney, Agent, or Firm* — NKL Law; Allen Xue

(57) ABSTRACT

A combined grinding wheel for ultrasonic machining and the determine method thereof. The combined grinding wheel for ultrasonic machining comprises: an outer grinding ring, an upper end thereof having a center taper hole and a plurality of outer grinding ring water holes located in a circumferential outer side of the center taper hole; a connecting taper shank, the upper end thereof having a taper shank extending into an outer grinding ring cavity from the center taper hole and matching the tapered surface of the center taper hole; a connecting flange, located outside the shank portion and fixed on the inner wall of the upper end of the outer grinding ring cavity, and having a center tapered through hole; and an inner vibration unit, having a tapered surface matching the tapered surface of the center tapered through hole and a center hole connected with the connecting taper shank by means of a screw.

9 Claims, 14 Drawing Sheets

(58) Field of Classification Search
CPC . B24D 7/18; B24D 7/005; B24D 7/06; B24D 7/14; B24D 7/16; B24B 1/04
See application file for complete search history.

(56) References Cited

FOREIGN PATENT DOCUMENTS

| | | | |
|---|---|---|---|
| CN | 107838767 | A | 3/2018 |
| CN | 109108818 | A | 1/2019 |
| CN | 109176167 | A | 1/2019 |
| CN | 208895870 | U | 5/2019 |
| FR | 2537034 | A1 * | 6/1984 |
| JP | 2010194651 | A | 9/2010 |
| JP | 2013132721 | A | 7/2013 |

* cited by examiner

D-D

COMBINED GRINDING WHEEL FOR ULTRASONIC MACHINING AND DESIGN METHOD THEREFOR

TECHNICAL FIELD

The present disclosure relates to the field of ultrasonic machining, in particular to a combined grinding wheel for ultrasonic machining and a design method thereof.

BACKGROUND

Hard and brittle materials, such as ceramic, silicon carbide and new-type composites, are more and more popularized in the manufacturing of key components in the fields of aerospace and transportation with the progress of technology. The excellent chemical and physical properties of these materials ensure their operational performance in harsh working environment, but the characteristics of hard and brittle of the materials bring challenges to the machining thereof. For traditional grinding method, the grinding force is large and the material is prone to surface cracks, chipping and other machining defects, which seriously affect the machining quality. And the grinding area has high temperature and tool wear is seriously, resulting in frequent tool replacement which restricts the improvement of machining efficiency. Therefore, in order to ensure the machining quality and efficiency, a high-quality and efficient machining method is required to meet the production requirements.

Ultrasonic assisted grinding technology is a new special machining technology combining ultrasonic vibration with ordinary wheel grinding. Researches show that ultrasonic assisted grinding can change the material removal mechanism, and has the characteristics of small cutting force, low cutting heat, high tool durability, high machining efficiency, and good machining surface quality in the machining process. In the machining filed of hard and brittle material parts having complex shape cavity and surface and thin wall, ultrasonic assisted grinding has obvious machining advantages and is considered to be an effective way to process hard and brittle materials.

Grinding wheel is an important tool of ultrasonic assisted grinding, and the ultrasonic grinding technology using cup-shaped grinding wheel is the main means of machining hard and brittle materials. However, the existing ultrasonic cup-shaped grinding wheel does not fully consider and give full play to the ultrasonic effect, resulting in the unreasonable structure of the grinding wheel, which is difficult to meet the requirements of high-quality and efficient machining of hard and brittle materials at the same time. It is mainly captured in: 1) the existing ultrasonic cup-shaped grinding wheel is in a single-layer cup-shaped structure. The effective grinding area of the grinding wheel is only within a smaller range of the outer ring surface of the grinding wheel and a large area inside the grinding wheel do not participate in grinding, which cannot fully exert the grinding ability of the internal area of the cup-shaped grinding wheel. 2) In the process of ultrasonic grinding, the material machining quality will be affected by the ultrasonic longitudinal vibration in a single direction. Considering that the cup-shaped grinding wheel used in the existing ultrasonic assisted grinding process has a simple structure and the vibration form is a single longitudinal vibration, the existing grinding wheel cannot achieve the effect of ultrasonic high-quality machining. 3) The grinding wheel produces a lot of heat in the grinding process, which increases the temperature of the grinding area so as to affect the machining quality and efficiency. The structure of the existing grinding wheel has a large enclosed space, which makes it difficult for the cutting fluid to enter the grinding area inside the grinding wheel, resulting in lower heat dissipation efficiency which is not conducive to reducing the temperature of the grinding area. At the same time, chips in the grinding process are difficult to discharge, which affects the machining quality and efficiency.

Therefore, in order to realize high-quality and efficient machining of materials, on the premise of fully considering and making use of the characteristics of ultrasonic machining, it is necessary to design a reasonable grinding wheel structure, give full play to the removal effect of ultrasonic action in the internal area of the grinding wheel on materials, combine a variety of ultrasonic vibration forms in the grinding process of the grinding wheel, and solve the problems of heat dissipation and chip removal of the traditional ultrasonic grinding wheel, which is not only a key problem to be solved in the design process of ultrasonic grinding wheel, but also a challenge to the design of ultrasonic grinding wheel.

SUMMARY OF THE INVENTION

It is an object of the present disclosure is to provide a combined grinding wheel for ultrasonic machining and a design method thereof, used in the process of machining hard and brittle materials. The combined grinding wheel of the present disclosure has inner layer and outer layer vibration units, the inner vibration unit as g attachment is in connection with the connecting flange to give full play to the machining ability of ultrasonic assisted grinding, which can improve the production efficiency. The inner layer vibration unit includes active heat dissipation disk and auxiliary inner grinding ring, which can meet different machining requirements in the case of combining with the outer layer grinding ring. The shape and installation position of the connecting flange can be changed according to the mode of the outer grinding ring so as to reduce the friction at the pitch circle and node, so that ultrasonic vibration of different amplitudes and vibration modes can be obtained at the outer diameter of the grinding wheel and ultrasonic vibration at other positions such as grinding wheel connection can be suppressed. The inner side of the connecting flange is in connection with the inner vibration unit by means of tapered surface, which reduces the loss of ultrasonic transmission between interfaces, ensuring the efficiency of ultrasonic transmission and improving the locate accuracy. The connecting flange is in connection with the inner vibration unit by means of tapered surface and has certain elasticity, so that the axial height between the inner and outer vibration units can be adjusted so as to meet various working conditions.

In order to solve the above technical problems, the present disclosure adopts the following technical solutions:

A combined grinding wheel for ultrasonic machining, including:

An outer grinding ring, an upper end thereof has a center taper hole and a plurality of outer grinding ring water holes located at a circumferential outer side of the center taper hole, and a lower end thereof has an outer grinding ring cavity communicated with the center taper hole and the outer grinding ring water holes, wherein a lower end of the outer grinding ring cavity is open. An outer wall of the outer grinding ring corresponding to the outer grinding ring cavity has provided with a plurality of outer layer grinding ring chutes communicated with the outer grinding ring cavity, wherein a rabbet of the outer grinding ring chute is located at a lower end face of the outer grinding ring. The position of the outer grinding ring water hole coincides with a pitch diameter position of the outer grinding ring in the pitch diameter mode. The outer grinding ring has two modes of pitch circle mode and pitch diameter mode within the working frequency range, and the pitch diameter is uniformly distributed around the axial direction. In this case, the outer grinding ring water holes not only enable the grinding fluid enter the inner vibration unit, but also reduce the energy loss caused by invalid vibration and reduce the weight of the grinding wheel;

A connecting taper shank, a lower end thereof has a shank portion inserting into the outer grinding ring cavity from the center taper hole and matching a tapered surface of the center taper hole. The outer wall of a tapered section of the shank portion located in the outer grinding ring cavity is in thread connection with a tapered or circular nut, and an upper end face of the nut fits with an inner wall of the upper end of the outer grinding ring cavity. The center of the outer grinding ring is a taper hole which is convenient for accurately centering when matching the tapered surface of the connecting taper shank, so that the outer grinding ring has better coaxiality with the main spindle. The tapered surface connection is more closely, which can reduce the loss of energy when transmitting ultrasonic vibration, thereby reducing the generation of heat and improving the machining efficiency. Besides, the tapered surface connection has the self-locking capability in the ultrasonic vibration process so as to make the machining safer;

A connecting flange, which is located outside the shank portion and fixed on the inner wall of the upper end of the outer grinding ring cavity, and has a center tapered through hole; and An inner vibration unit, which has a tapered surface matching the tapered surface of the center tapered through hole and a center hole connected with the connecting taper shank by means of a screw. The tapered surface of the inner vibration unit can realize the function of vibration transmission and location.

The outer grinding ring chutes are evenly distributed around the axis of the outer grinding ring, and has an inclined angle of 0° to 90°, a width of 1 to 10 mm, and a ratio of groove depth to groove width of 1~10. The outer grinding ring chute enables the longitudinal ultrasonic vibration transmitted by the amplitude transformer to derive the ultrasonic amplitude along the tangential direction of the outer grinding ring, so as to change the single longitudinal ultrasonic vibration into longitudinal-torsional composite vibration which make the abrasive particle trajectory more complex, thereby improving the quality of machining. In addition, the chute has a larger area and better heat dissipation effect than the straight groove, which is more conductive to reducing the temperature of the grinding area.

The connecting taper shank is a step shaft composed of coaxially connected cylindrical shank and tapered shank, wherein the cylindrical shank portion is disposed at the upper end of the tapered shank and connected with a ultrasonic tool holder.

The outer wall of the cylindrical shank has a section of external threads connected with a retracting nut.

The outer wall of the tapered section of the tapered shank located in the outer grinding ring cavity has a process groove.

When the outer grinding ring connects to the connecting taper shank, an upper portion of the process groove is located in the center taper hole and a lower portion of the process groove is located in the outer grinding ring cavity. The process groove plays the role of relief groove. And when the outer grinding ring connects to the connecting taper shank, the outer grinding ring is fastened on the tapered surface by the nut, and the plane of the contact surface between the nut and the outer grinding ring passes the process groove just right, which plays the role of vibration isolation and friction reduction.

The connecting flange includes a flange end face and an annular clamping portion located at the upper end of the flange end face.

The flange end face has an annular groove coaxial with the center tapered through hole, which extends to the annular clamping portion along an axial direction of the connecting flange and separates the flange end face into a flange inner ring end face and a flange outer ring end face. The flange inner ring end face is lower than the flange outer ring end face, ensuring that the inner ring end face has enough movement space when the tapered surface is deformed.

The annular clamping portion has the center tapered through hole extending to the flange inner ring end face. A plurality of straight grooves are uniformly arranged in the circumferential direction of the annular clamping portion, wherein the extension direction of the straight groove is parallel to the axial direction of the connecting flange and the notch is located at the lower end face of the annular clamping portion.

A tapered angle of the center tapered through hole of the annular clamping portion is 45° to 90°.

When the mode of the outer grinding ring at working frequency is pitch circle mode, the above connecting flange structure is adopted. When the mode is pitch diameter mode, the following connecting flange structure is adopted.

A plurality of isolation grooves are uniformly arranged in the circumferential direction of the outer flange ring end face, wherein the isolation groove corresponds to the pitch diameter position of the outer grinding ring of the pitch diameter mode.

The isolation groove is fan-shaped having a depth of 0.1 mm to 3 mm and a central angle of 0° to 90°.

A rounded angle is arranged between the flange outer ring end face and the outer wall of the annular clamping portion. The lower end of the rounded angle is more than 1 mm lower than the bottom of the annular groove to ensure the transmission of ultrasonic energy.

The retracting nut has a guide hole in clearance fit with the cylindrical shank and an internal thread fitting the external thread. When installing, the inner thread of the retracting nut fits the outer thread on the connecting taper shank, and the guide hole is in clearance fit with the cylindrical shank. When retracting, by turning the retracting nut, the outer grinding ring, which is self-locking due to tapered surface fit, can be pushed open to facilitate the replacement of grinding ring.

The inner vibration unit is an active heat dissipation disk including a disk body having the center hole and a plurality of active heat dissipation disk water holes located in the circumferential direction of the center hole. An annular protrusion coaxial with the disk body is arranged on the disk body around the active heat dissipation disk water holes, wherein the outer wall of the annular protrusion has a tapered surface matching the tapered surface of the center tapered through hole. A relief groove of the active heat dissipation disk is arranged between the outer wall of the annular protrusion and the disk body. With the increase of screw fastening force, the pressure applied by the outer wall of the annular protrusion on the connecting flange increases, the connecting flange deforms, the center tapered through hole expands outward, and the active heat dissipation disk slides up along the center tapered through hole, so as to realize the adjustment of height of the active heat dissipation disk. The transmission efficiency of ultrasonic energy is high in tapered surface connection, which solves the problem of poor ultrasonic vibration of the active dissipation disk in threaded connection.

In another embodiment, the inner vibration unit is an auxiliary inner grinding ring, the upper end thereof having the center hole and a plurality of inner grinding ring water holes located in the circumferential direction of the center hole, and the lower end thereof having an inner grinding ring cavity communicated with the center hole and the inner grinding ring water holes. The outer wall of the upper portion of the auxiliary inner grinding ring has a tapered surface matching the tapered surface of the center tapered through hole, and the lower end face of the auxiliary inner grinding ring has a plurality of inner grinding ring chip spaces.

The auxiliary inner grinding ring chip spaces are evenly distributed around the axis of the outer grinding ring, which is convenient for heat dissipation and chip removal. The ultrasonic vibration form of the auxiliary inner grinding ring will change in terms of the chip space shape.

The outer wall of the lower portion of the auxiliary inner grinding ring has an annular protrusion. The upper end face of the annular protrusion is located in the same plane as the lower end face of the cylindrical cavity of the inner grinding ring cavity, and the circumferential direction of the annular protrusion has vertical grooves communicated with the inner grinding ring chip spaces. A relief groove is arranged between the outer wall of the upper portion of the auxiliary inner grinding ring and the upper end face of the annular protrusion. With the increase of screw fastening force, the pressure applied by the outer wall of the upper portion of the auxiliary inner grinding ring on the connecting flange increases, the connecting flange deforms, the center tapered through hole expands outward, and the auxiliary inner grinding ring slides up along the center tapered through hole, so as to realize the adjustment of height of the auxiliary inner grinding ring. The transmission efficiency of ultrasonic energy is high in tapered surface connection, which solves the problem of poor ultrasonic vibration of the auxiliary inner layer grinding ring in threaded connection.

The active heat dissipation disk can improve the heat dissipation capacity of grinding wheel by means of ultrasonic atomization. The auxiliary inner grinding ring and the outer grinding ring form a double grinding ring structure; by adjusting the height difference of the end faces of the inner and outer grinding rings, rough and finishing machining can be realized in one process, which can give full play to the grinding ability of ultrasonic assisted grinding.

The present disclosure also discloses a method for determining a combined grinding wheel for ultrasonic machining, including the following steps:

The vibration mode of the combined grinding wheel is determined according to machining requirements. The outer grinding ring selects a pitch circle mode when a larger amplitude is required, and the outer layer grinding ring selects a pitch diameter mode when a smaller amplitude is required.

A size of the outer grinding ring is determined, according to a determined vibration mode, to enable the outer grinding ring to realize the required mode at working frequency. The size of the inner vibration unit is determined, according to the size of the outer grinding ring, to enable the inner vibration unit to be installed in the outer grinding ring cavity and have appropriate axial adjustment.

A size of the connecting taper shank is determined, according to the sizes of the inner layer vibration unit and the outer layer grinding ring to ensure, after the inner vibration unit connects to the outer grinding ring, a contact between the outer grinding ring and the taper shank is a node of ultrasonic wavelength and the inner vibration unit has appropriate axial adjustment.

A position of the outer grinding ring water hole is determined, wherein the position of the outer grinding ring water hole coincides with the pitch diameter position of the outer grinding ring in the pitch diameter mode.

The connecting flange is determined, according to the vibration mode of the outer grinding ring, wherein the connecting flange can be divided into pitch circle type and pitch diameter type, which are applicable to the pitch circle mode and the pitch diameter mode of the outer grinding ring respectively. An inner ring diameter of the connecting flange of the pitch circle type is larger than the pitch diameter of the outer layer grinding ring. The end face of the connecting flange of the pitch diameter type has an isolation groove at the corresponding pitch diameter of the outer grinding ring.

All the determined parts are assembled to obtain the combined grinding wheel for ultrasonic machining.

When the working mode of the outer grinding ring is selected as the pitch circle mode, the connecting flange includes a flange end face and an annular clamping portion located at the lower end of the flange end face.

The flange end face has an annular groove coaxial with the center tapered through hole, which extends to the annular clamping portion along an axial direction of the connecting flange and separates the flange end face into a flange inner ring end face and a flange outer ring end face. The flange inner ring end face is lower than the flange outer ring end face, ensuring that the inner ring end face has enough movement space when the tapered surface is deformed.

The annular clamping portion has the center tapered through hole extending to the flange inner ring end face. A plurality of straight grooves are uniformly arranged in the circumferential direction of the annular clamping portion, wherein the extension direction of the straight groove is parallel to the axial direction of the connecting flange and the notch is located at the lower end face of the annular clamping portion.

The annular groove and the straight groove are configured to reduce the rigidity of the annular clamping portion and increase its deformation capacity.

A taper angle of the center tapered through hole of the clamping portion is 45° to 90°.

When the working mode of the outer grinding ring is selected as the pitch diameter mode, the connecting flange includes the flange end face and the annular clamping portion located at the upper end of the flange end face.

The flange end face has an annular groove coaxial with the center tapered through hole, which extends to the annular clamping portion along an axial direction of the connecting flange and separates the flange end face into a flange inner ring end face and a flange outer ring end face. The flange inner ring end face is lower than the flange outer ring end face.

The annular clamping portion has the center tapered through hole extending to the flange inner ring end face. A plurality of straight grooves are uniformly arranged in the circumferential direction of the annular clamping portion, wherein the extension direction of the straight groove is parallel to the axial direction of the connecting flange and the notch is located at the lower end face of the annular clamping portion.

A taper angle of the taper hole of the clamping portion is 45° to 90°.

And, a plurality of isolation grooves are uniformly arranged in the circumferential direction of the outer flange ring end face, and the isolation groove corresponds to the pitch diameter position of the outer layer grinding ring.

The isolation groove is fan-shaped having a depth of 0.1 mm to 3 mm and a central angle of 0° to 90°.

When the combined grinding wheel is working, the ultrasonic energy is input through the connecting taper shank. Some of the ultrasonic energy is transmitted to the outer grinding ring through the matching tapered surface between the connecting taper shank and the outer grinding ring, and the longitudinal ultrasonic vibration transmitted by the amplitude transformer derives ultrasonic amplitude along the tangential direction of the outer grinding ring under the action of the outer grinding ring chute, so that the single longitudinal ultrasonic vibration is changed into longitudinal-torsional composite vibration. Other ultrasonic energy is transmitted to the inner vibration unit through the connecting tapered surface between the connecting flange and the inner vibration unit, so that the inner vibration unit also generates ultrasonic vibration. The determining method fully considers the friction at the pitch circle, pitch diameter and the node.

The present disclosure not only solves the problem of ultrasonic energy transmission of the combined grinding wheel, but also solves the problem of axial adjustment of the inner and outer vibration units.

The combined grinding wheel for ultrasonic machining (having an auxiliary inner grinding ring) of the present disclosure can reduce the friction at the pitch circle and node, realize rough machining and finishing machining in one process, improve the production efficiency and change the groove form of the inner and outer grinding rings. The present disclosure can obtain different types of ultrasonic vibration to meet different machining requirements and further improve the machining quality. The combined grinding wheel for ultrasonic machining (having an active heat dissipation disk) of the present disclosure conveniently realizes the composite vibration of the grinding wheel, and uses the properties of ultrasonic vibration for active cooling to enhance the heat dissipation capacity and improve the grinding efficiency.

Based on the above reasons, the present disclosure can be widely popularized in the ultrasonic machining and other fields.

DETAILED DESCRIPTION OF DRAWINGS

The drawings used in the embodiments or the prior art will be briefly described herein to more clearly describe the embodiments of the present invention or the technical solutions in the prior art. Apparently, the following described drawings are merely embodiments of the present invention. For those ordinary skilled in the art, other drawings can also be obtained according to the provided drawings without creative labor.

FIG. 1 is a flow diagram of the method for determining a combined grinding wheel for ultrasonic machining in embodiment 1 of the present disclosure.

FIGS. 2*a* and 2*b* are a modal analysis diagram of the outer grinding ring in embodiment 1 of the present disclosure (FIG. 2*a*. pitch circle mode, FIG. 2*b*. double pitch diameter mode).

Figure 7A:
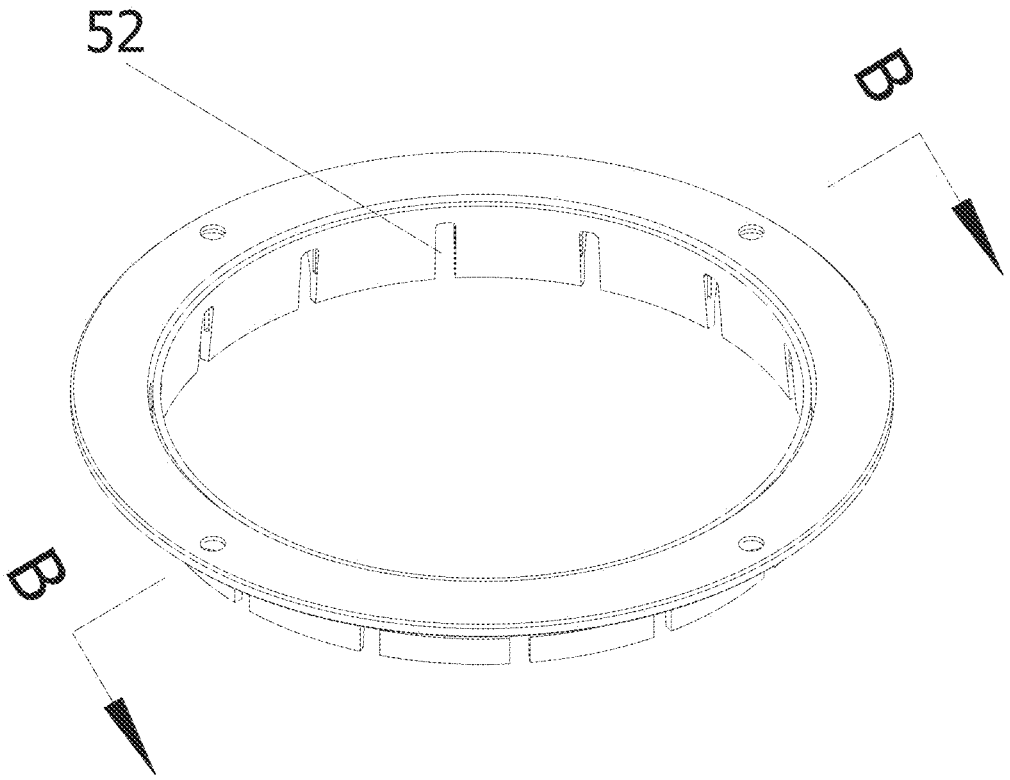
Figure 7B:
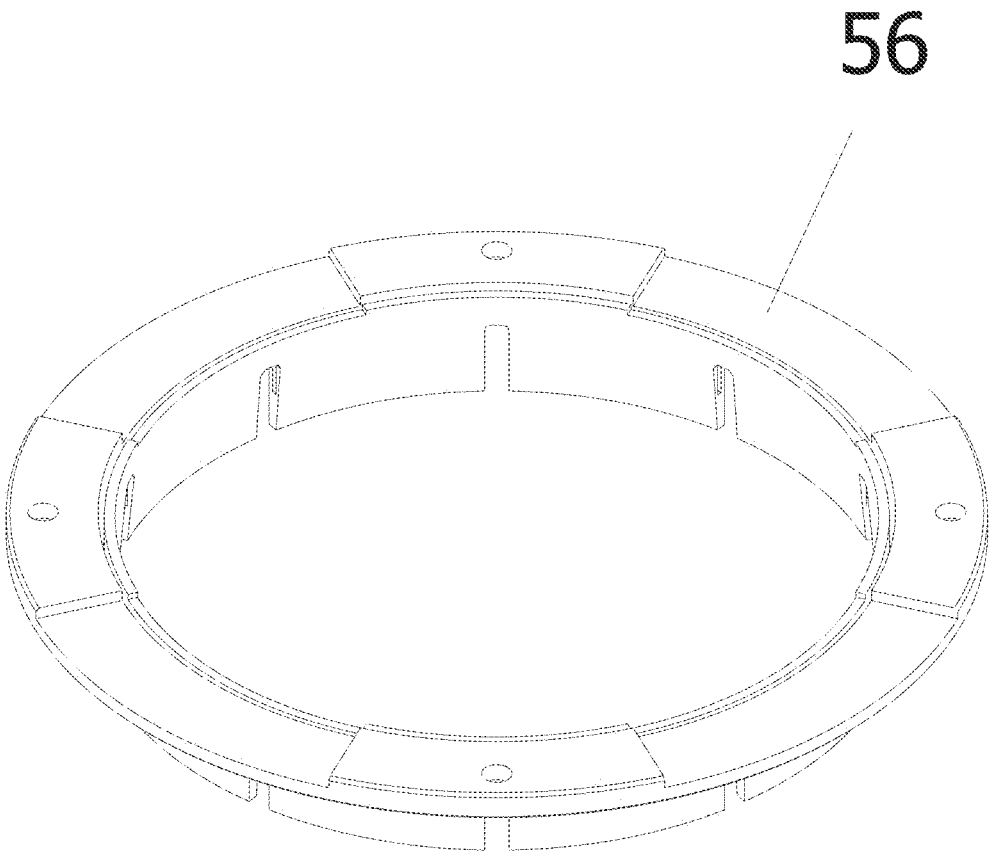

FIGS. 7*a* and 7*b* are an overall view of two forms of the connecting flange in embodiment 1 of the present disclosure (FIG. 7*a*. connecting flange of pitch circle type; FIG. 7*b*. connecting flange of second pitch diameter type).

Figure 8:
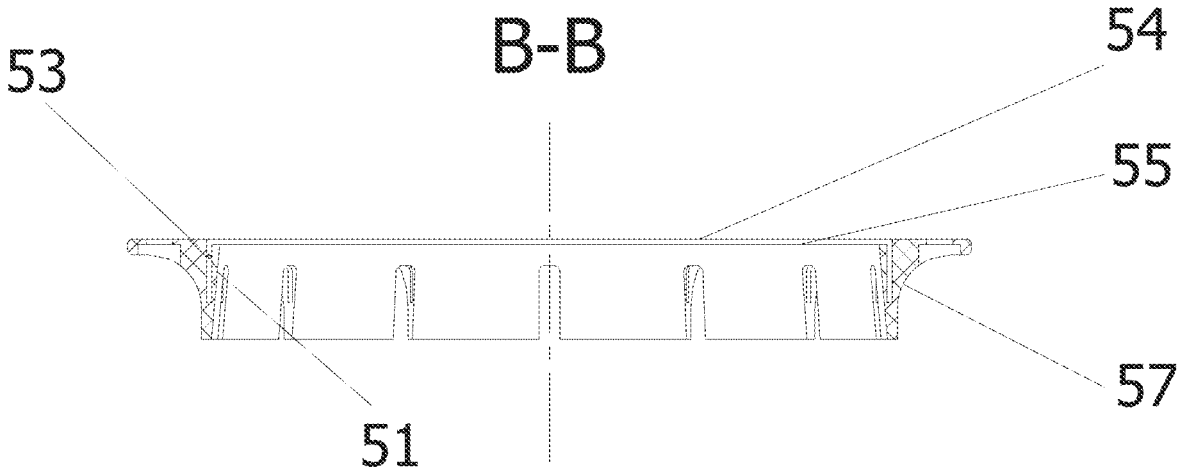

FIG. 8 is a sectional view in a B-B direction in FIGS. 7*a* and 7*b*.

Figure 9:
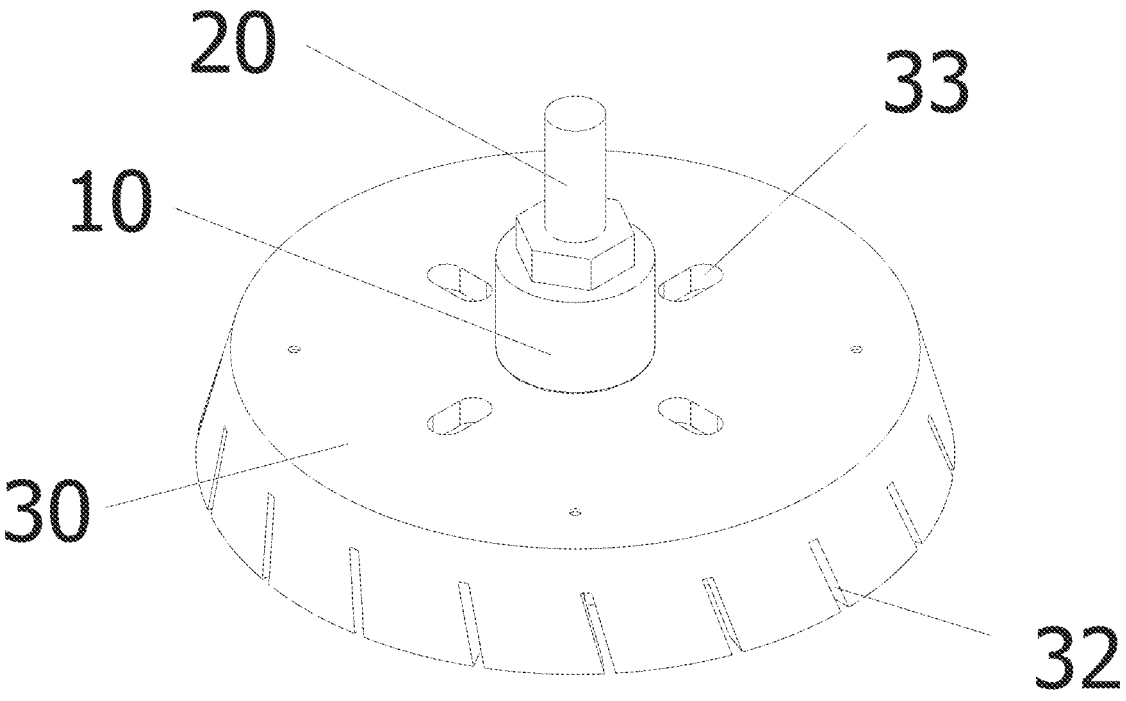

FIG. 9 is a schematic diagram of the overall structure of the combined grinding wheel for ultrasonic machining in embodiment 2 of the present disclosure.

Figure 10:
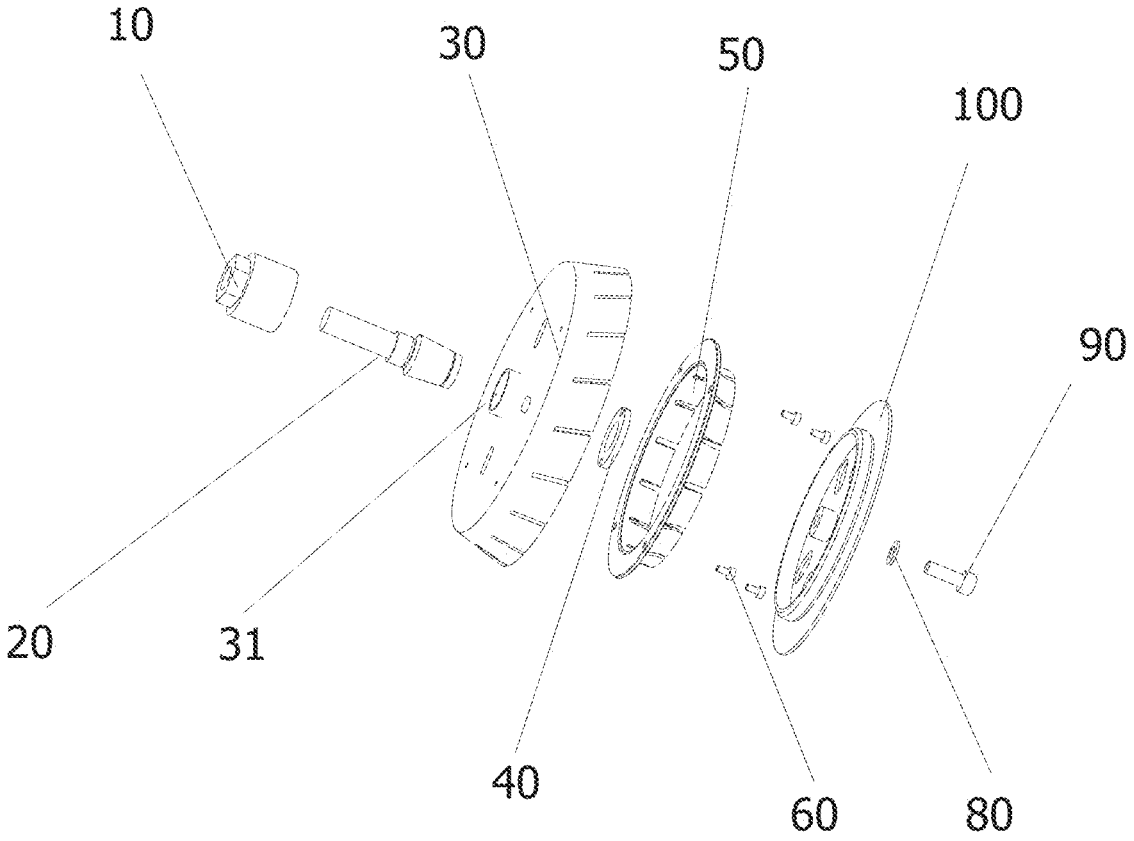

FIG. 10 is an exploded diagram of the combined grinding wheel for ultrasonic machining in embodiment 2 of the present disclosure.

Figure 11:
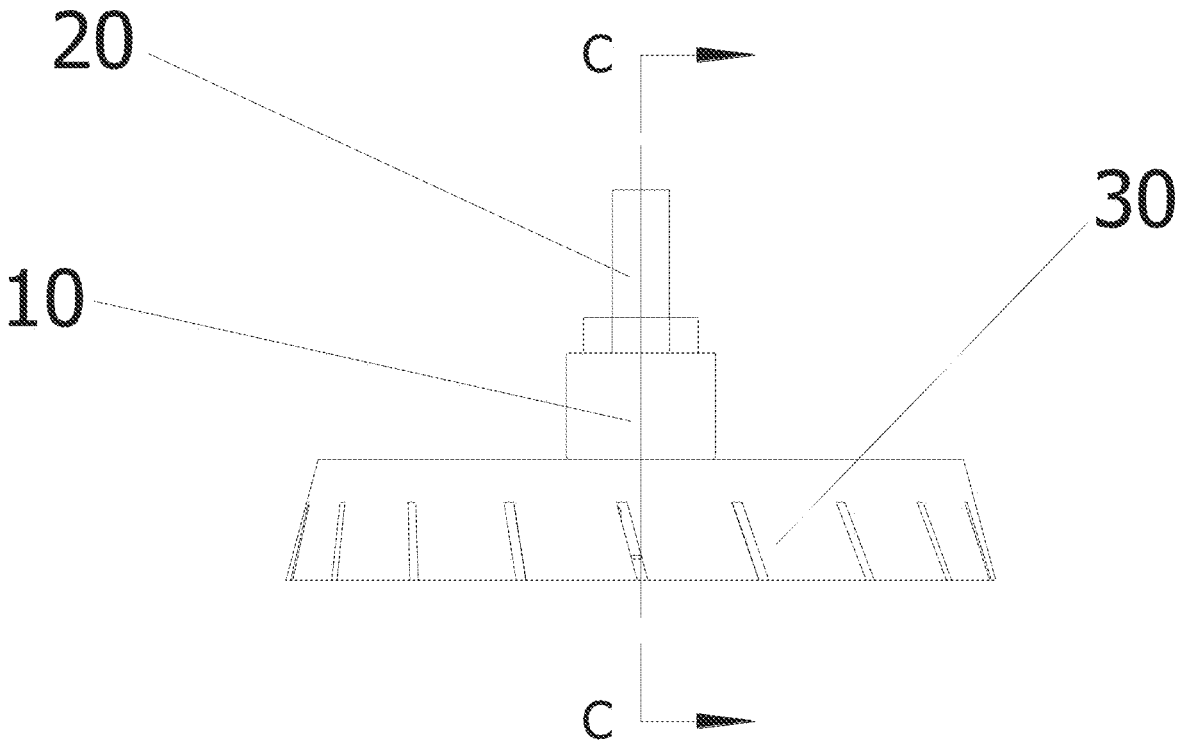

FIG. 11 is the main view of the combined grinding wheel for ultrasonic machining in embodiment 2 of the present disclosure.

Figure 12:
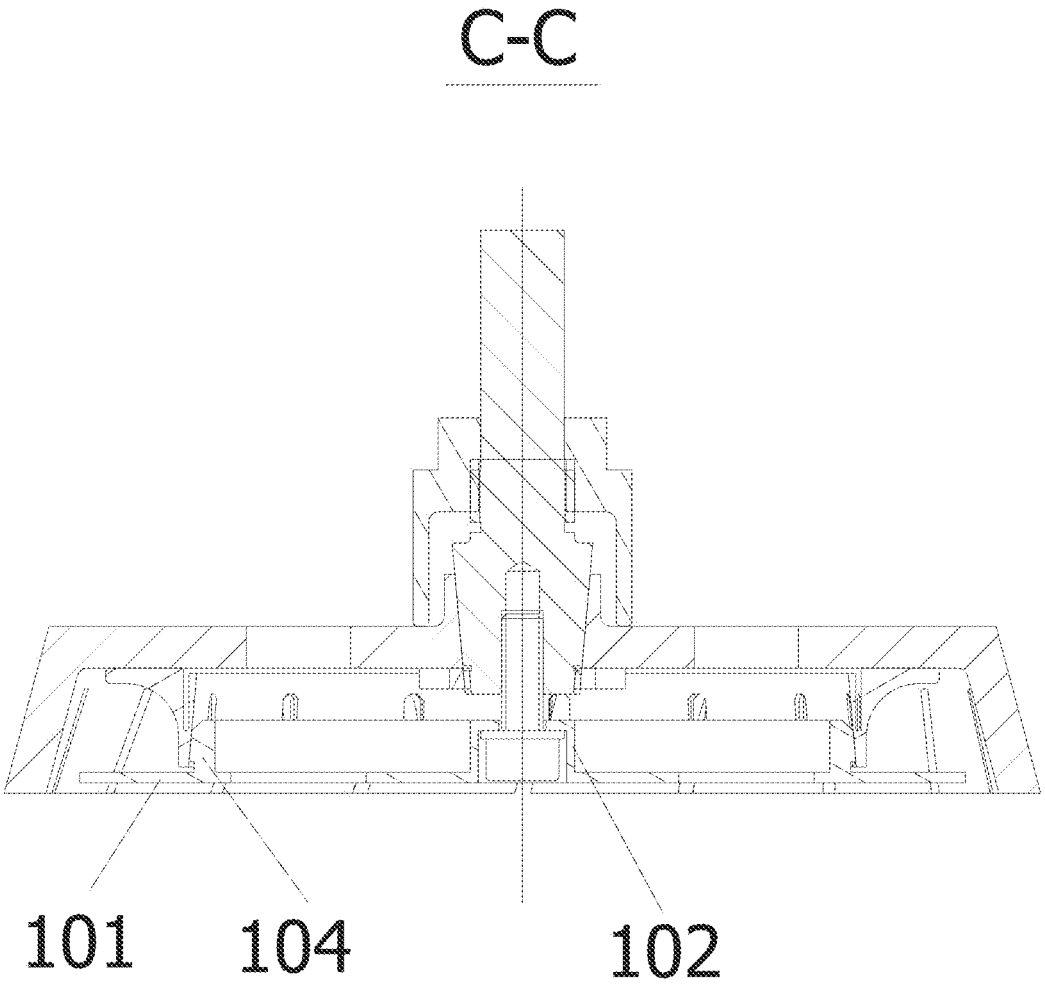

FIG. 12 is a sectional view in a C-C direction in FIG. 11.

Figure 13:
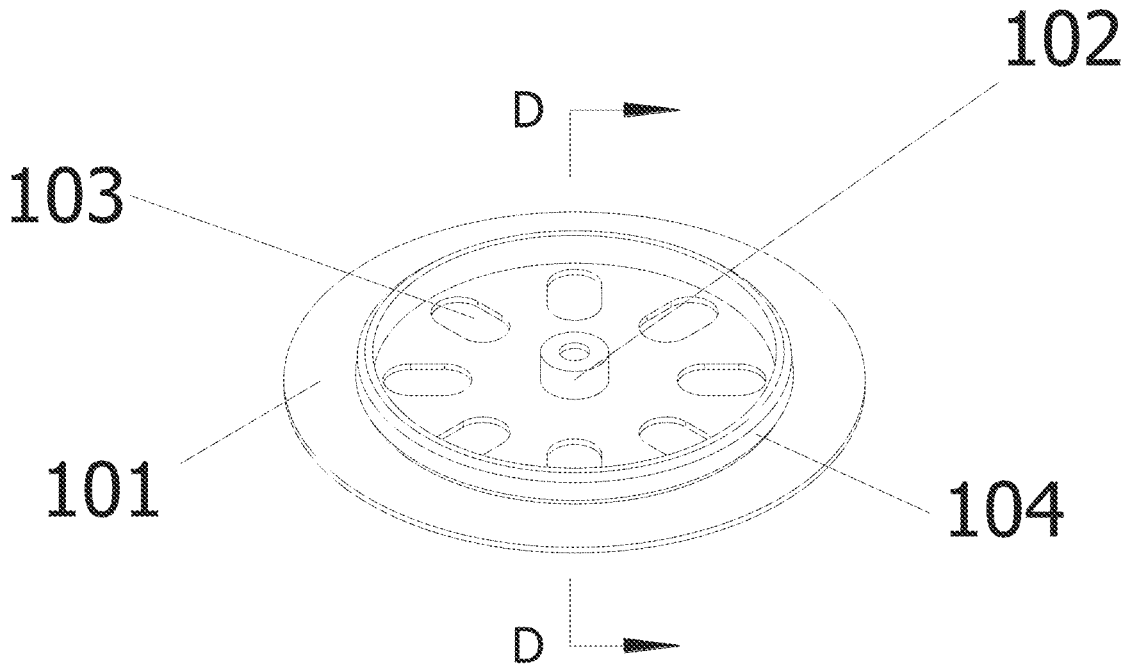

FIG. 13 is the main view of the active heat dissipation disk in embodiment 2 of the present disclosure.

Figure 14:
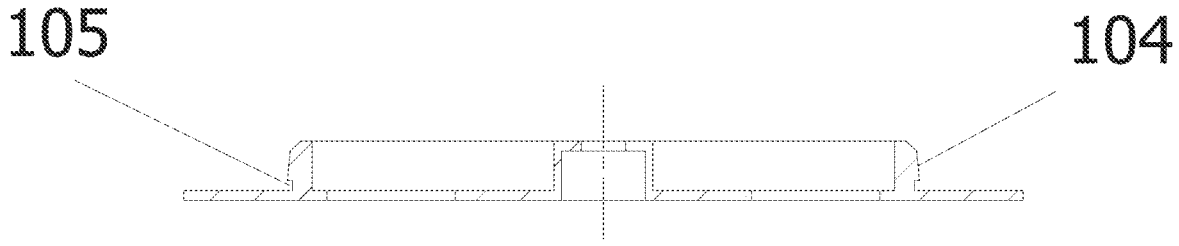

FIG. 14 is a sectional view in a D-D direction in FIG. 13.

DETAILED DESCRIPTION OF PREFERRED EMODIMENTS

To make the objectives, technical solutions, and advantages of the present disclosure clearer, a clear and complete description of the technical solutions in embodiments of the present invention will be presented in conjunction with the accompanying drawings. Obviously, the described embodiments are only some, but not all, embodiments of the invention. According to the embodiments of the present invention, all other embodiments obtained by those ordinary skilled in the art without creative labor should fall within the protection scope of the present invention.

Embodiment 1

Figure 1:
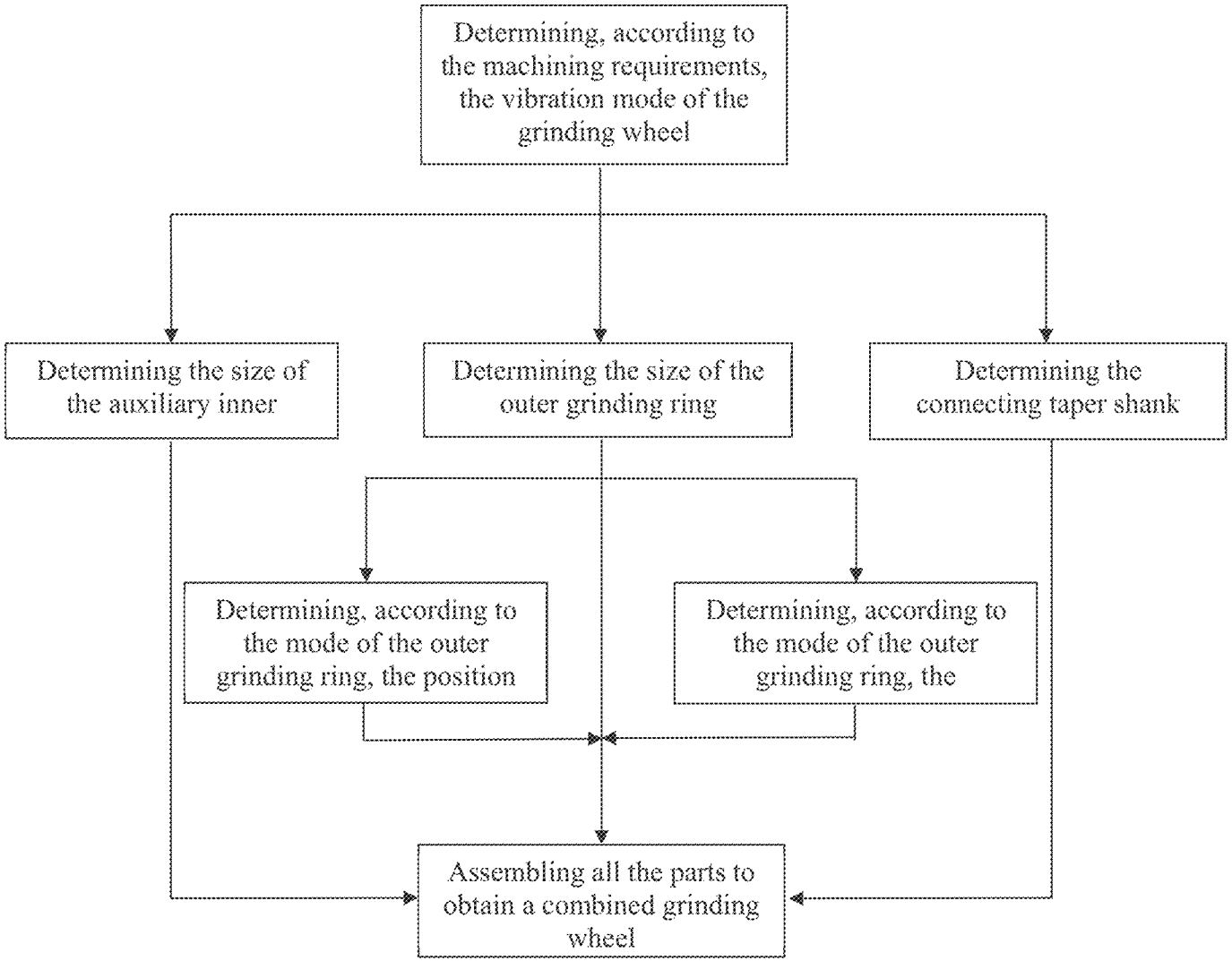

As shown in FIG. 1, a method for determining a combined grinding wheel for ultrasonic machining includes the following steps:

Firstly, the working conditions are judged, and the mode of the required combined grinding wheel is determined according to the machining requirements. The pitch circle mode is selected when larger amplitude is required, and the pitch diameter mode is selected when smaller amplitude is required, taking the double pitch diameter mode as an example. The size of the outer grinding ring 30 is determined according to the mode of the combined grinding wheel so as to meet the mode requirements in the working state. The upper end of the outer grinding ring 30 has a center taper hole 31 and a plurality of outer grinding ring water holes 33 located at the circumferential outer side of the center taper hole 31, and the lower end of the outer grinding ring 30 has an outer grinding ring cavity 34 communicated with the center taper hole 31 and the outer grinding ring water holes 33, wherein a lower end of the outer grinding ring cavity is open. The outer wall of the outer grinding ring 34 corresponding to the outer grinding ring cavity 34 has a plurality of outer grinding ring chutes 32 communicated with the outer grinding ring cavity 34, wherein the rabbet of the outer grinding ring chute 32 is located at the lower end face of the outer grinding ring 30.

The positions of the outer grinding ring water hole 33 are determined. The positions of the outer grinding ring water hole 33 coincide with the pitch diameter positions of the outer grinding ring in the double pitch diameter mode.

The connection between the connecting taper shank 20 and the outer grinding ring 30 is determined. The lower end of the connecting taper shank 20 has a shank portion inserting into the outer grinding ring cavity 34 from the center taper hole 31 and matching the tapered surface of the center taper hole 31. The outer wall of the tapered section of the shank portion located in the outer grinding ring cavity 34 is in thread connection with a nut 40, and the upper end face of the nut 40 fits with the inner wall of the upper end of the outer grinding ring cavity 34.

The type of the connecting flange 50 is determined according to the working mode of the outer grinding ring 30. The connecting flange 50 is located outside the shank portion and fixed on the inner wall of the upper end of the outer grinding ring cavity 34, and has a center tapered through hole.

The inner vibration unit is installed. In this embodiment, the inner vibration unit is an auxiliary inner grinding ring 70. The upper end of the auxiliary inner grinding ring 70 has the center hole and a plurality of inner grinding ring water holes 72 located in the circumferential direction of the center hole, and the lower end of the auxiliary inner grinding ring 70 has an inner grinding ring cavity 74 communicated with the center hole and the inner grinding ring water holes 72. The outer wall 71 of the upper portion of the auxiliary inner grinding ring 70 has a tapered surface matching the tapered surface of the center tapered through hole, and the lower end face of the auxiliary inner grinding ring 70 has a plurality of inner grinding ring chip spaces 73. The center hole is provided with a screw 90 in connection with the lower end of the shank portion. The height of the auxiliary inner grinding ring 70 changes in terms of the fastening force of the screw 90.

The determined combined grinding wheel for ultrasonic machining includes a retracting nut 10, a connecting taper shank 20, an outer grinding ring 30, a nut 40, a connecting flange 50, a flange fastening screw 60, an auxiliary inner grinding ring 70, and a gasket 80 and a screw 90 for fastening the auxiliary inner grinding ring. The outer grinding ring 30 connects to the connecting taper shank 20 through the center taper hole 31 and is locked with a nut 40. The connecting flange 50 is fixed on the inner wall of the upper end of the outer grinding ring cavity 34 through four screws 60. The center hole of the connecting flange 50 is a tapered through hole having a smaller taper. The outer wall 71 of the upper portion of the auxiliary inner grinding ring 70 matches the center tapered through hole by means of tapered surface to transmit vibration and locate. The auxiliary inner grinding ring 70 is fixed by the gasket 80 and the screw 90. Passing through the gasket 80 and the center hole of the auxiliary inner grinding ring 70, the screw 90 is fastened to the connecting taper shank 20.

The outer grinding ring chutes 32 with equal intervals are arranged in the circumferential direction of the outer grinding ring 30, having an inclined angle of 0° to 90°, a width of 1 to 10 mm, and a ratio of groove depth to groove width of 1 to 10. The chute enables the longitudinal ultrasonic vibration transmitted by the amplitude transformer to derive the ultrasonic amplitude along the tangential direction of the outer grinding ring, so as to change the single longitudinal ultrasonic vibration into longitudinal-torsional composite vibration which make the abrasive particle trajectory more complex, thereby improving the machining quality. Moreover, the chute has a larger area and better heat dissipation effect than the straight groove, which is more conducive to reducing the temperature of the grinding area. The inner grinding ring chip spaces 73 with equal intervals are arranged at the lower end of the auxiliary inner grinding ring 70 to facilitate heat dissipation and chip removal.

Figure 2A:
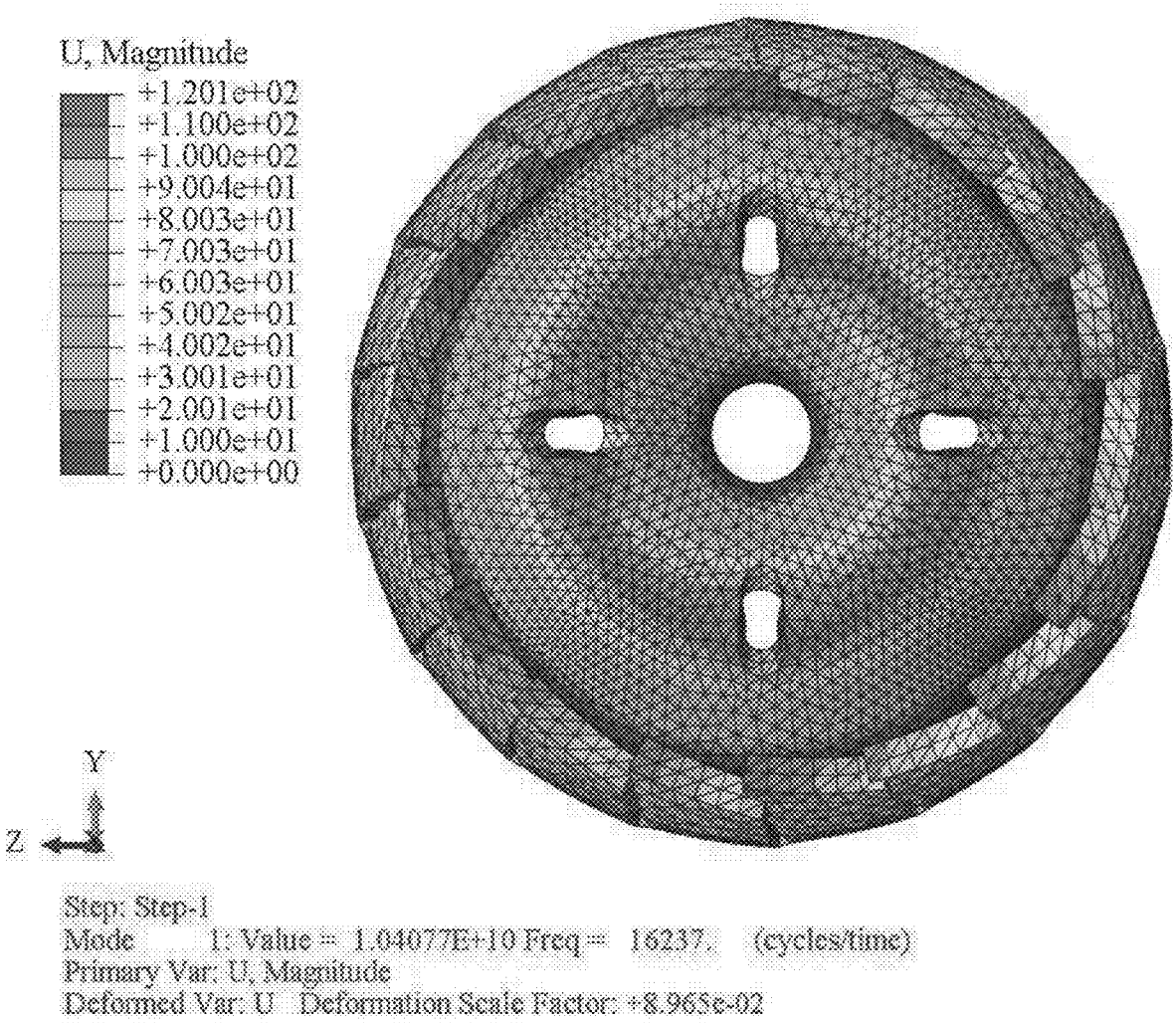
Figure 2B:
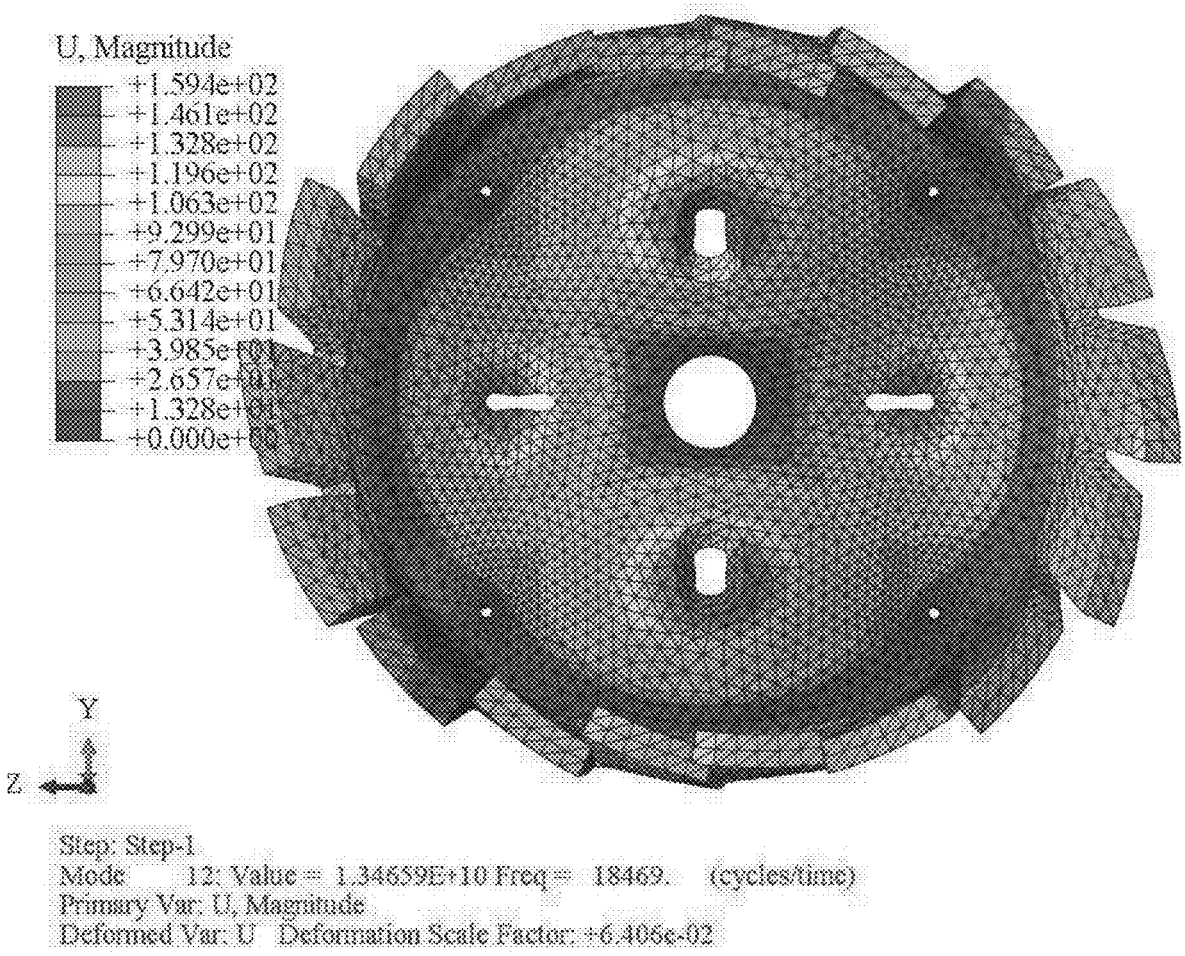

Four outer grinding ring water holes 33 are uniformly distributed on the outer grinding ring 30, and their positions coincide with the pitch diameter positions of the outer grinding ring 30 in the double pitch diameter mode. FIGS. 2*a* and 2*b* are a modal analysis diagram of the outer grinding ring. The outer grinding ring has pitch circle mode and pitch diameter mode in the working frequency range. Taking the double pitch diameter mode as an example, the double pitch diameters are evenly distributed around the axial direction. In this instance, the outer grinding ring water holes 33 not only enable the grinding fluid to enter the auxiliary inner grinding ring 70, but also reduce the energy loss caused by invalid vibration and reduce the weight of the grinding wheel.

The center taper hole 31 of the outer grinding ring 30 matches the tapered surface of the connecting taper shank, which is convenient for accurately centering, so that the outer grinding ring 30 has better coaxiality with the main spindle. The tapered surface connection is more closely, which can reduce the loss of energy when transmitting ultrasonic vibration, thereby reducing the generation of heat and improving the machining efficiency. Moreover, the tapered surface connection has self-locking capability in the ultrasonic vibration process so as to make the machining safer.

Figure 3:
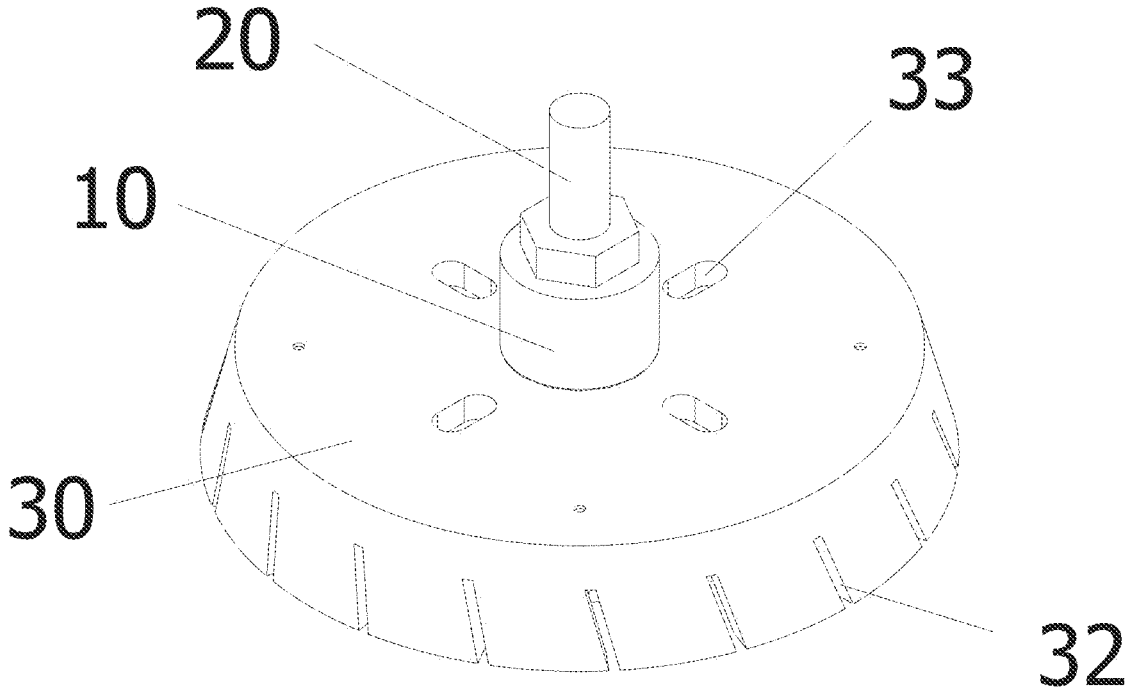
FIG. 3 is a schematic diagram of the overall structure of the combined grinding wheel for ultrasonic machining in embodiment 1 of the present disclosure.
Figure 4:
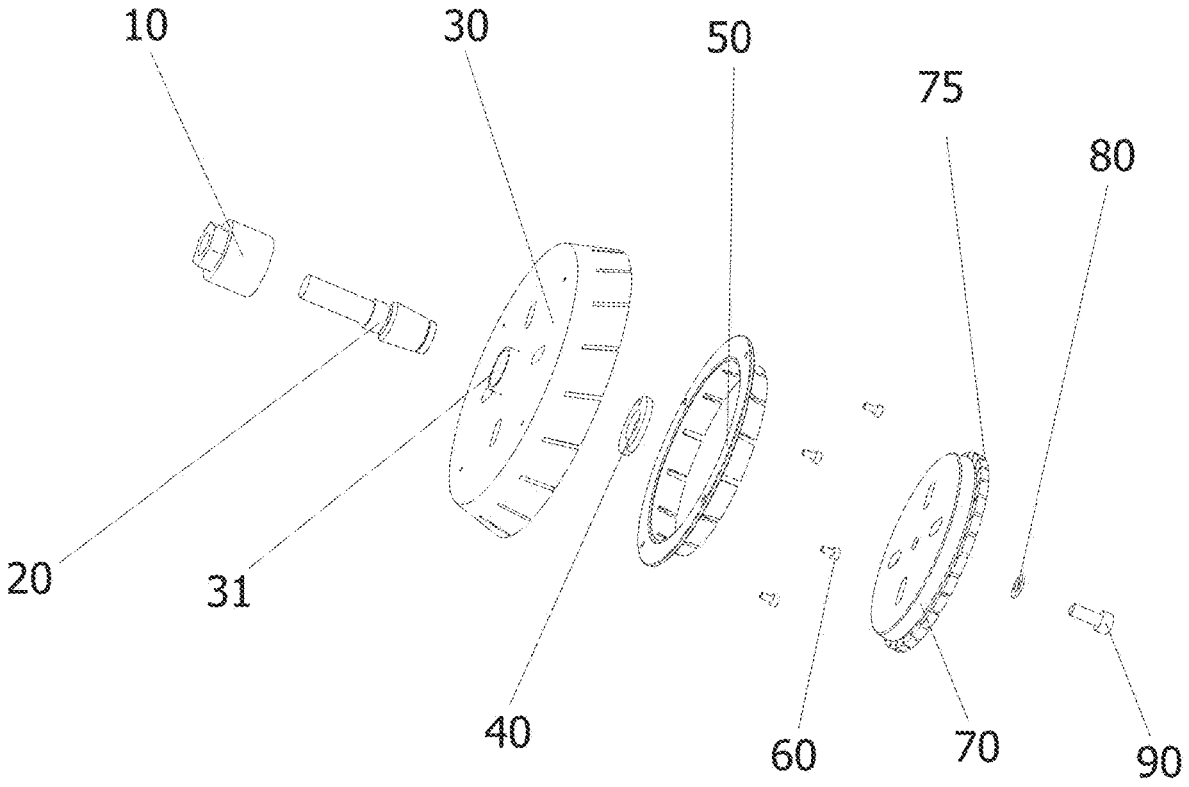
FIG. 4 is an exploded diagram of the combined grinding wheel for ultrasonic machining in embodiment 1 of the present disclosure.
Figure 5:
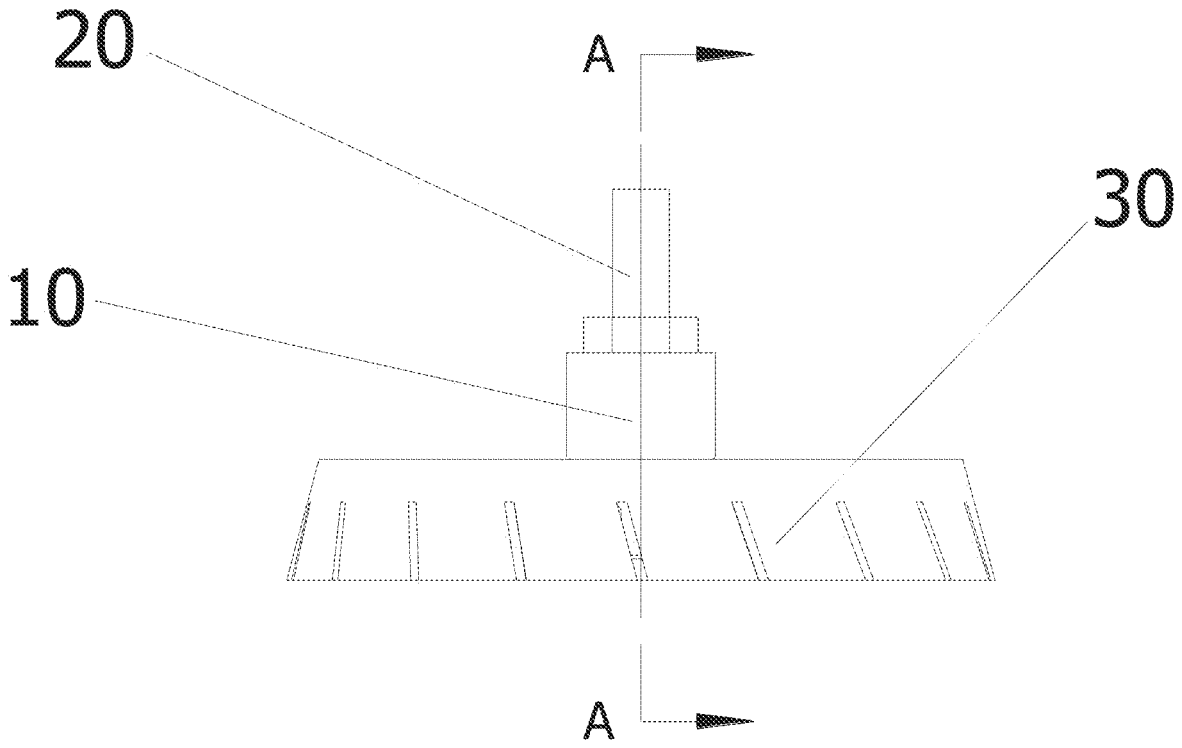
FIG. 5 is the main view of the combined grinding wheel for ultrasonic machining in embodiment 1 of the present disclosure.
Figure 6:
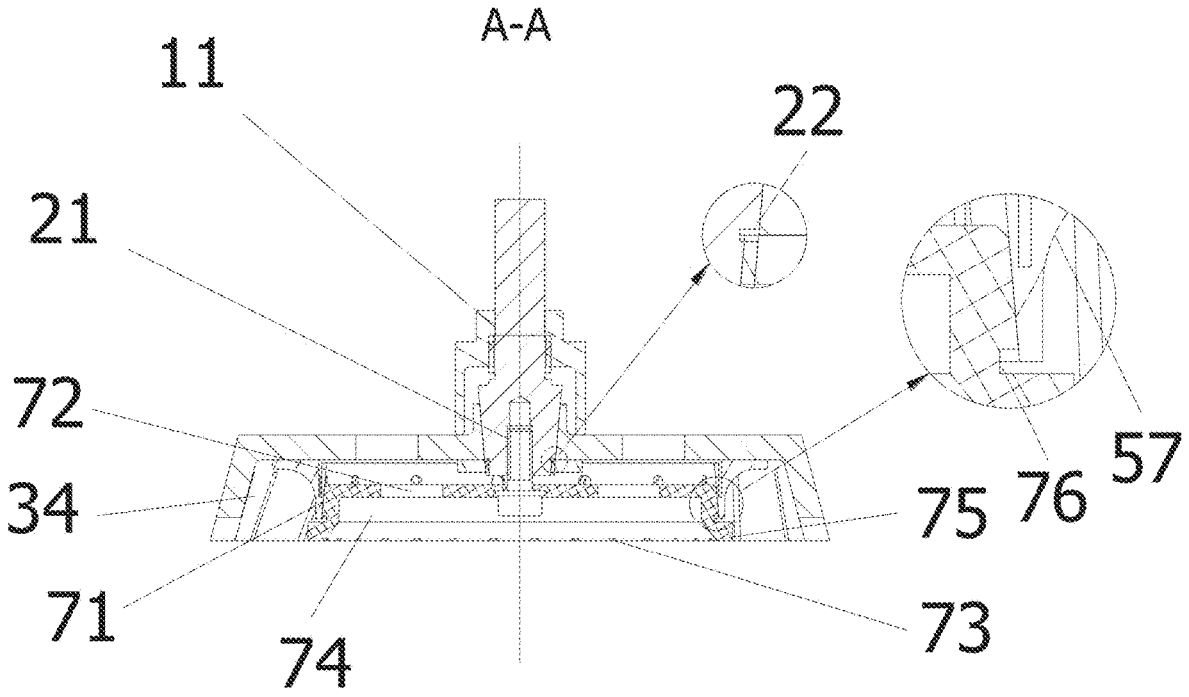
FIG. 6 is a sectional view in an A-A direction in FIG. 5.

As shown in FIGS. 3 to 5, the connecting taper shank 20 is a step shaft composed of coaxially connected cylindrical shank and tapered shank. The cylindrical shank is used to connect with the spring collet and can be quickly clamped on the ultrasonic cutting holder. The cylindrical shank has a section of external thread connected the retracting nut 10. The taper shank has a section of taper thread, and the upper end of the taper thread is provided with a process groove 22 having a width of 2 mm and a depth of 1 mm. The process groove 22 not only plays the role of relief groove, but also fastens the outer grinding ring 30 on the tapered surface with the nut 40 when the outer grinding ring matches the connecting taper shank 20. The plane of the contact surface between the nut 40 and the outer grinding ring 30 passes the process groove 22 just right, which plays the role of vibration isolation and friction reduction, as shown in FIG. 6. The connecting taper shank 20 has a threaded hole 21 to connect with the screw 90 so as to fasten the auxiliary inner grinding ring 70.

As shown in FIGS. 7*a*, 7*b* and 8, the connecting flange 50 has different forms. As shown in FIGS. 2*a* and 2*b*, the mode of the outer grinding ring 30 at the working frequency is analyzed. The connecting flange of pitch circle type in FIGS. 7*a* and 7*b* is adopted when the mode is pitch circle type, and the connecting flange of double pitch diameter type in FIGS. 7*a* and 7*b* is adopted when the mode is double pitch diameter type.

As shown in FIG. 7*a*, the inner ring surface of the connecting flange of the pitch circle type is a tapered surface 51, that is, the center tapered through hole, having a taper angle of 45° to 90°. The connecting flange of the pitch circle type includes a flange end face and an annular clamping portion located at the lower end of the flange end face. The flange end face has an annular groove 53 coaxial with the center tapered through hole. The annular groove 53 extends to the annular clamping portion along the axial direction of the connecting flange of the pitch circle type, and separates the flange end face into the flange inner ring end face 54 and the flange outer ring end face 55. The flange inner ring end face 54 is 0.2 to 0.5 mm lower than the flange outer ring end face 55, so as to ensure that the flange inner ring end face 54 has enough movement space when the tapered surface is deformed. The annular clamping portion has the center tapered through hole extending to the flange inner ring end face 54. The annular clamping portion is evenly provided with a plurality of straight grooves 52 in the circumferential direction. The extension direction of the straight groove 52 is parallel to the axial direction of the connecting flange of the pitch circle type, and the notch is located at the lower end face of the annular clamping portion. The straight groove 52 and the annular groove 53 are configured to reduce the rigidity of the connecting flange of the pitch circle type and increase its deformation capacity.

As shown in FIG. 7*b*, the connecting flange of the double pitch diameter type has four more isolation grooves 56 than the connecting flange of the pitch circle type. The four isolation grooves 56 are distributed uniformly around the axial direction and correspond to the pitch diameter position of the outer grinding ring 30. The isolation groove 56 is fan-shaped having a depth of 0.1 mm to 3 mm and a central angle of 0° to 90°.

A rounded angle 57 is arranged between the flange outer ring end face 55 and the outer wall of the annular clamping portion. The lower end of the rounded angle 57 is more than 1 mm lower than the bottom of the annular groove, ensuring the transmission of ultrasonic energy.

The outer wall 71 of the upper portion of the auxiliary inner grinding ring 70 matches the tapered surface of the center tapered through hole. When installing, the two surfaces are matched to locate the auxiliary inner grinding ring 70. The auxiliary inner grinding ring 70 is fastened on the connecting taper shank 20 with the gasket 80 and the screw 90. With the increase of fastening force, the pressure applied by the outer wall 71 of the upper portion of the auxiliary inner grinding ring 70 on the connecting flange 50 increases, the connecting flange 50 deforms, the center tapered through hole expands outward, and the auxiliary inner grinding ring 70 slides up along the center tapered through hole, so as to realize the adjustment of height of the auxiliary inner grinding ring 70. The transmission efficiency of ultrasonic energy is high in tapered surface connection, which solves the problem of poor ultrasonic vibration of the auxiliary inner grinding ring 70 in threaded connection. The auxiliary inner grinding ring 70 has four water holes 72 enabling the grinding fluid to enter the inner grinding ring cavity 74 so as to enter the grinding area. The lower end face of the auxiliary inner grinding ring 70 has chip spaces 73 of the inner grinding ring in the circumferential direction to facilitate heat dissipation and chip removal, and to enrich the vibration mode of the auxiliary inner grinding ring 70.

The outer wall of the lower portion of the auxiliary inner grinding ring 70 has an annular protrusion 75. The upper end face of the annular protrusion is located in the same plane as the lower end face of the cylindrical cavity 77 of the inner grinding ring cavity 74, and the circumferential direction of the annular protrusion has vertical grooves communicated with the inner grinding ring chip spaces 73.

A relief groove 76 is arranged between the outer wall 71 of the upper portion of the auxiliary inner 1 grinding ring 70 and the upper end face of the annular protrusion 75.

As shown in FIG. 6, the retracting nut 10 has a guide hole 11 and a section of internal thread at the middle. When installing, the internal thread of the retracting nut 10 matches the external thread of the connecting taper shank 20, and the guide hole 11 is in small clearance fit with the cylindrical shank. When retracting, by turning the retracting nut 10, the outer grinding ring 30, which is self-locking due to tapered surface fit, can be pushed open so as to facilitate the replacement of grinding ring Embodiment 2

As shown in FIGS. 9 to 14, the distinguishing characteristic between a combined grinding wheel for ultrasonic machining of this embodiment and that in embodiment 1 is that the inner vibration unit is an active heat dissipation disk 100. The active heat dissipation disk 100 includes a disk body 101. The middle portion of the upper end of disk body 101 has a cylindrical protrusion 102 and a plurality of active heat dissipation disk water holes 103 around the cylindrical protrusion 102. The lower end of the cylindrical protrusion 102 has a groove accommodating the head of the screw 90, and the upper end of the cylindrical protrusion 102 has a center hole passing through the bottom of the groove. An annular protrusion 104 coaxial with the disk body 101 is arranged on the disk body 101 around the active heat dissipation disk water holes 103, and the outer wall of the annular protrusion 104 has a tapered surface matching the tapered surface of the center tapered through hole. A relief groove 105 of the active heat dissipation disk is arranged between the outer wall of the annular protrusion 104 and the disk body 101.

At last, it should be stated that the above various embodiments are only used to illustrate the technical solutions of the present disclosure without limitation; and despite reference to the aforementioned embodiments to make a detailed description of the present invention, those of ordinary skilled in the art should understand: the described technical solutions in above various embodiments may be modified or the part of or all technical features may be equivalently substituted; while these modifications or substitutions do not make the essence of their corresponding technical solutions deviate from the scope of the technical solutions of the embodiments of the present disclosure.

The invention claimed is:

1. A combined grinding wheel for ultrasonic machining, comprising:

an outer grinding ring, an upper end thereof having a center taper hole and a plurality of outer grinding ring water holes located at a circumferential outer side of the center taper hole, and a lower end thereof having an outer grinding ring cavity communicated with the center taper hole and the outer grinding ring water holes, wherein a lower end of the outer grinding ring cavity is open, and an outer wall of the outer grinding ring corresponding to the outer grinding ring cavity has a plurality of outer grinding ring chutes communicated with the outer grinding ring cavity, wherein a rabbet of the outer grinding ring chute is located at a lower end face of the outer grinding ring;

a connecting taper shank, a lower end thereof having a shank portion inserting into the outer grinding ring cavity from the center taper hole and matching a tapered surface of the center taper hole, wherein the outer wall of a tapered section of the shank portion located in the outer grinding ring cavity is in thread connection with a tapered or circular nut, and an upper end face of the nut fits with an inner wall of an upper end of the outer grinding ring cavity;

a connecting flange located outside the shank portion and fixed on the inner wall of the upper end of the outer grinding ring cavity, and having a center tapered through hole; and an inner vibration unit having a tapered surface matching a tapered surface of the center tapered through hole and a center hole connected with the connecting taper shank by means of a screw.

2. The combined grinding wheel for ultrasonic machining according to claim 1, wherein the outer grinding ring chutes are evenly distributed around an axis of the outer grinding ring, and has an inclined angle of 0° to 90°, a width of 1 to 10 mm, and a ratio of depth to width of 1 to 10.

3. The combined grinding wheel for ultrasonic machining according to claim 1, wherein the connecting taper shank is a step shaft composed of coaxially connected cylindrical shank and tapered shank, wherein the cylindrical shank is disposed at the upper end of the tapered shank and connected with a ultrasonic tool holder;

the outer wall of the cylindrical shank has a section of external threads connected with a retracting nut;

the outer wall of a tapered section of the tapered shank located in the outer grinding ring cavity has a process groove;

when the outer grinding ring connects to the connecting taper shank, an upper portion of the process groove is located in the center taper hole and a lower portion of the process groove is located in the outer grinding ring cavity.

4. The combined grinding wheel for ultrasonic machining according to claim 1, wherein the connecting flange comprises a flange end face and an annular clamping portion located at the lower end of the flange end face; wherein, the flange end face has an annular groove coaxial with the center tapered through hole, which extends to the annular clamping portion along an axial direction of the connecting flange and separates the flange end face into a flange inner ring end face and a flange outer ring end face, wherein the flange inner ring end face is lower than the flange outer ring end face;

the annular clamping portion has the center tapered through hole extending to the flange inner ring end face, and a plurality of straight grooves are uniformly arranged in the circumferential direction of the annular clamping portion, wherein an extension direction of the straight groove is parallel to the axial direction of the connecting flange and a notch is located at a lower end face of the annular clamping portion; and a tapered angle of the center tapered through hole of the annular clamping portion is 45° to 90°.

5. The combined grinding wheel for ultrasonic machining according to claim 4, wherein a plurality of isolation grooves are evenly arranged in the circumferential direction of the flange outer ring end face, and the plurality of isolation grooves corresponds to a pitch diameter position of the outer grinding ring in a pitch diameter mode.

6. The combined grinding wheel for ultrasonic machining according to claim 4, wherein a rounded angle is arranged between the flange outer ring end face and an outer wall of the annular clamping portion, and a lower end of the rounded angle is more than 1 mm lower than a bottom of the annular groove.

7. The combined grinding wheel for ultrasonic machining according to claim 3, wherein the retracting nut has a guide hole in clearance fit with the cylindrical shank and an internal thread fitting the external thread.

8. The combined grinding wheel for ultrasonic machining according to claim 1, wherein the inner vibration unit is an active heat dissipation disk comprising a disk body having the center hole and a plurality of active heat dissipation disk water holes located in the circumferential direction of the center hole, wherein an annular protrusion coaxial with the disk body is arranged on the disk body around the active heat dissipation disk water holes, wherein the outer wall of the annular protrusion has a tapered surface matching the tapered surface of the center tapered through hole, and a relief groove of the active heat dissipation disk is arranged between the outer wall of the annular protrusion and the disk body.

9. The combined grinding wheel for ultrasonic machining according to claim 1, wherein the inner vibration unit is an auxiliary inner grinding ring, an upper end thereof having the center hole and a plurality of inner grinding ring water holes located in the circumferential direction of the center hole, and a lower end thereof having an inner grinding ring cavity communicated with the center hole and the inner grinding ring water holes, wherein an outer wall of an upper portion of the auxiliary inner grinding ring has a tapered surface matching the tapered surface of the center tapered through hole, and the lower end face of the auxiliary inner grinding ring has a plurality of inner grinding ring chip spaces; wherein, an outer wall of a lower portion of the auxiliary inner grinding ring has an annular protrusion, wherein an upper end face of the annular protrusion is located in a same plane as an lower end face of a cylindrical cavity of the inner grinding ring cavity, and the circumferential direction of the annular protrusion has vertical grooves communicated with the inner grinding ring chip spaces; and a relief groove is arranged between the outer wall of the upper portion of the auxiliary inner grinding ring and the upper end face of the annular protrusion.

* * * * *